US012404764B2

(12) United States Patent
Nafa et al.

(10) Patent No.: US 12,404,764 B2
(45) Date of Patent: Sep. 2, 2025

(54) COMPLETION NIPPLE IDENTIFIER TOOL

(71) Applicant: SAUDI ARABIAN OIL COMPANY, Dhahran (SA)

(72) Inventors: Hamed M. Nafa, Dhahran (SA); Hussain S. Hunidi, Dhahran (SA); Majid D. Al-Hajjaji, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 11 days.

(21) Appl. No.: 18/351,055

(22) Filed: Jul. 12, 2023

(65) Prior Publication Data

US 2025/0020053 A1 Jan. 16, 2025

(51) Int. Cl.
*E21B 47/098* (2012.01)

(52) U.S. Cl.
CPC ..... *E21B 47/098* (2020.05)

(58) Field of Classification Search
CPC ..... E21B 47/098
See application file for complete search history.

(56) References Cited

U.S. PATENT DOCUMENTS 1,460,436 A * 7/1923 Nichols ..... E21B 47/098 73/152.57
2,416,441 A * 2/1947 Grant ..... E21B 33/127 73/152.57
3,049,752 A * 8/1962 Jorda ..... E21B 47/098 73/104
3,905,227 A * 9/1975 Kinley ..... E21B 47/098 73/152.57
4,659,530 A * 4/1987 Boyers ..... E21B 47/098 264/315
8,561,705 B2 * 10/2013 Wilson ..... E21B 47/098 166/336
9,289,922 B2 * 3/2016 King ..... B29C 35/0261
10,954,752 B2 3/2021 Manson et al.
11,634,981 B1 * 4/2023 Kumar ..... E21B 37/00 166/250.09
12,024,994 B1 * 7/2024 Alsulaim ..... E21B 47/006
2022/0106850 A1 4/2022 McAllister et al.

FOREIGN PATENT DOCUMENTS

AU 2017417925 B2 2/2023

* cited by examiner

*Primary Examiner* — Robert E Fuller
(74) *Attorney, Agent, or Firm* — Osha Bergman Watanabe & Burton LLP

(57) ABSTRACT

A tubing nipple impression device for use within downhole tubing includes a driver body, a stopping disk, first and second impression arms, and upper and lower radial springs. The driver body extends in an axial direction along a vertical axis of the downhole tubing. The driver body further includes a nose portion, and first and second driver arms that abut against the stopping disk. The shear pin attaches the driver body to the stopping disk. The first and second impression arms are fixed to the stopping disk, and are further connected to each other with upper and lower radial springs. The first and second impression arms are actuated by the nose portion to form first and second impressions complimentary to first and second portions of a tubing nipple, respectively, when the first and second impression arms abut against the tubing nipple.

20 Claims, 4 Drawing Sheets

COMPLETION NIPPLE IDENTIFIER TOOL

BACKGROUND

During the process of preparing a well for drilling operations, completion tubing is installed in the well to form a barrier between a subterranean formation and the wellbore. The completion tubing is typically formed of materials such as steel, and creates a conduit from the bottom of the wellbore, where production fluids may be found, to the surface of the Earth for further processing. A common part of well completion tubing is the nipple. A nipple is a completion component fabricated as a short section of thick tubular with a machined internal surface that provides a seal area and a locking profile for attaching various devices thereto. There are many types of nipples utilized in well completions based upon their required functionality, including No-Go Nipples, Selective-Landing Nipples, and Ported Safety Valve Nipples, for example.

In well intervention operations and in order to install flow-control devices, such as plugs, chokes, or sub-service safety valves, the type of nipples must be identified prior to the job. In many cases, particularly for wells with outdated completion tubing, the type of nipple may not be accurately reflected in the drilling records. Furthermore, if a flow-control device with an incorrect seating profile is installed, the flow-control device will become stuck, resulting in a loss of well production and potentially the entire well intervention string.

SUMMARY

A tubing nipple impression device for use within downhole tubing includes a driver body, a stopping disk, first and second impression arms, and upper and lower radial springs. The driver body extends in an axial direction along a vertical axis of the downhole tubing. The driver body further includes a nose portion, and first and second driver arms that abut against the stopping disk. The shear pin attaches the driver body to the stopping disk. The first and second impression arms are fixed to the stopping disk, and are further connected to each other with upper and lower radial springs. The first and second impression arms are actuated by the nose portion to form first and second impressions complimentary to first and second portions of a tubing nipple, respectively, when the first and second impression arms abut against the tubing nipple.

A method for creating an impression of a tubing nipple includes attaching a driver body to a stopping disk with a shear pin. The driver body extends in an axial direction along a vertical axis of downhole tubing and includes a nose portion, a first driver arm, and a second driver arm. The stopping disk abuts against the first driver arm and the second driver arm. The method further includes fixing a first impression arm and a second impression arm to the stopping disk. The first impression arm is connected to the second impression arm with an upper radial spring and a lower radial spring. The first impression arm and the second impression arm are then actuated towards the tubing nipple with the nose portion of the driver body, causing the first impression arm and the second impression arm to abut against the tubing nipple. In this way, the method further includes forming a first impression complimentary to a first portion of the tubing nipple, and forming a second impression complimentary to a second portion of the tubing nipple while the impression arms abut against the tubing nipple.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a wellbore as described herein. In this respect, the term "upper" denotes an element disposed closer to the surface of the Earth than a corresponding "lower" element when the tubing nipple impression device is in the wellbore, while the term "lower" conversely describes an element disposed further from the surface of the Earth than a corresponding "upper" element. Likewise, the term "axial" refers to an orientation substantially parallel to an extension direction of a completion tubular and wellbore, while the term "radial" denotes a direction orthogonal to an axial direction. Similarly, the terms "vertical" and "vertically" refer to an axial direction (i.e., the primary extension direction of the wellbore) while the terms "lateral" and "laterally" refer to the radial direction orthogonal to a vertical direction.

In general, one or more embodiments of the disclosure are directed towards a device for creating an impression of an unknown nipple of completion tubing in a wellbore. The device includes a first impression arm and a second impression arm that abut against the nipple portion of the completion to create a partial impression of the nipple. More specifically, the first impression arm and the second impression arm each include a lead (or equivalent soft material) body that molds to the shape of the nipple. In this way, the first impression arm and the second impression arm replicate the unknown structure of the completion tubing nipple, which is analyzed at the surface by an engineer or operator to determine the type of nipple present.

Figure 1:
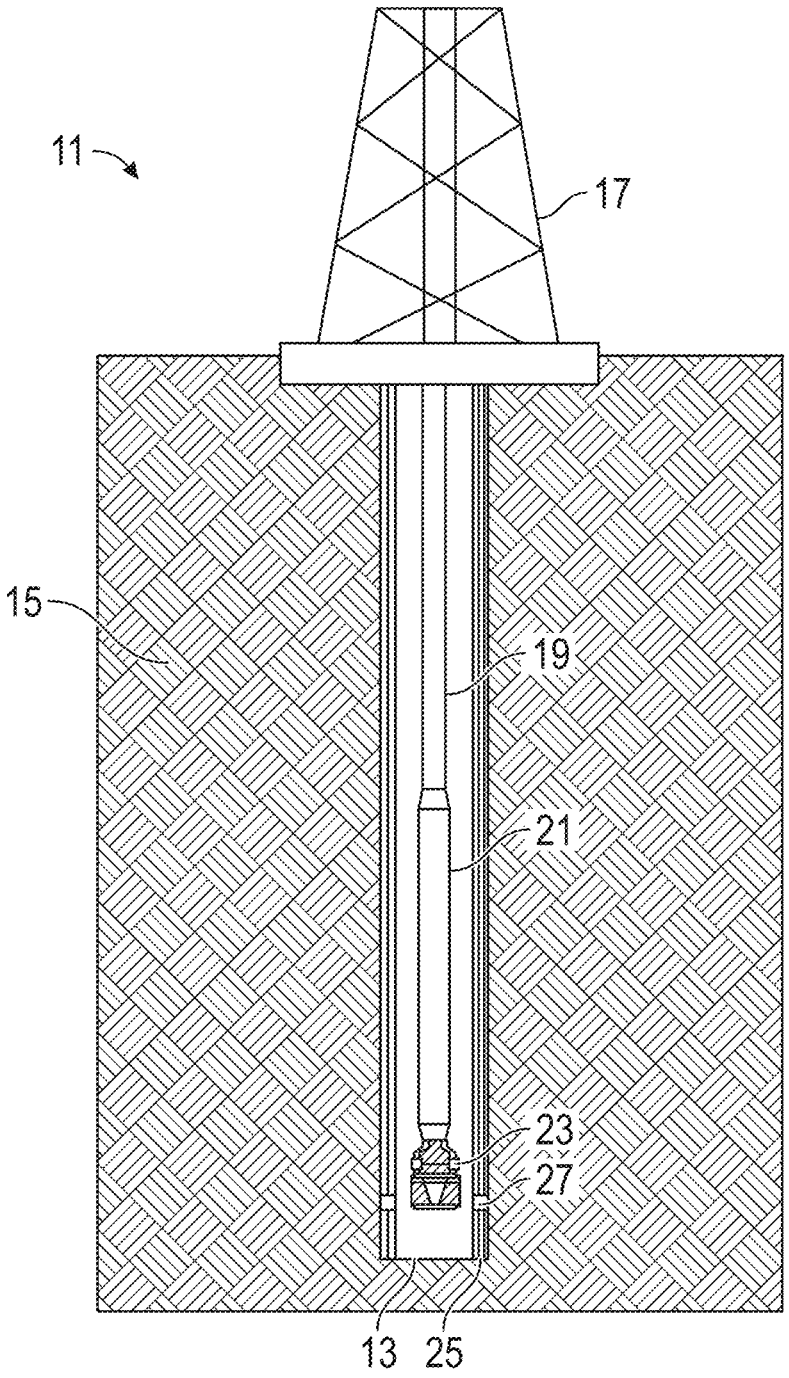
FIG. 1 depicts a well site in accordance with one or more embodiments of the invention.

FIG. 1 shows a schematic diagram illustrating an example of a well site 11. In general, well sites are configured in a myriad of ways. Therefore, the well site 11 is not intended to limit the particular configuration of the drilling equipment. For example, the well site 11 is depicted as being on land, however the well site 11 may be offshore and drilling may be carried out with or without the use of a marine riser. Moreover, various components and details of the well site that would be well known to a person of ordinary skill in the art have been omitted for the sake of brevity.

A drilling operation at the well site 11 is initiated by drilling a wellbore 13, or borehole, into a subterranean formation 15. Once the wellbore 13 has been drilled, completion tubing 25 is cemented against the subterranean formation 15 to form a conduit for fluid transmission. The completion tubing 25 includes a tubing nipple 27, which provides a sealing surface and locking profile for attaching downhole components thereto. Both the completion tubing 25 and the tubing nipple 27 may be formed of one or more varieties of steel (such as martensitic steel, duplex steel, or a steel alloy), and the tubing nipple 27 has a thickened wall to enhance its durability. Once the completion tubing 25 is installed, downhole operations may commence to acquire oil and gas from reserves in the wellbore 13.

However, and as noted above, a profile of a tubing nipple 27 may not be known. For example, if the schematics or logs of the wellbore 13 are incomplete, the tubing nipple 27 may not be properly marked. Alternatively, if the tubing nipple 27 becomes damaged from a well operation, the profile of the tubing nipple 27 will change. To address this, the slickline 19 is attached to a fishing neck (e.g., FIG. 3) of the tubing nipple impression device 23. In this way, the tubing nipple impression device 23 is axially actuated throughout the wellbore 13 by the slickline 19 until the tubing nipple impression device 23 is able to capture a profile of the tubing nipple 27. Once the tubing nipple impression device 23 has captured the profile of the tubing nipple 27, the tubing nipple impression device 23 is lifted to the surface of the Earth by the slickline 19. This allows a production engineer or operator to analyze the profile of the tubing nipple 27 captured by the tubing nipple impression device 23, which, in turn, allows the tubing nipple 27 itself to be identified. After the tubing nipple 27 is identified, well operations may resume by attaching downhole components to the tubing nipple 27 and/or documenting the geometry of the tubing nipple 27.

Figure 2:
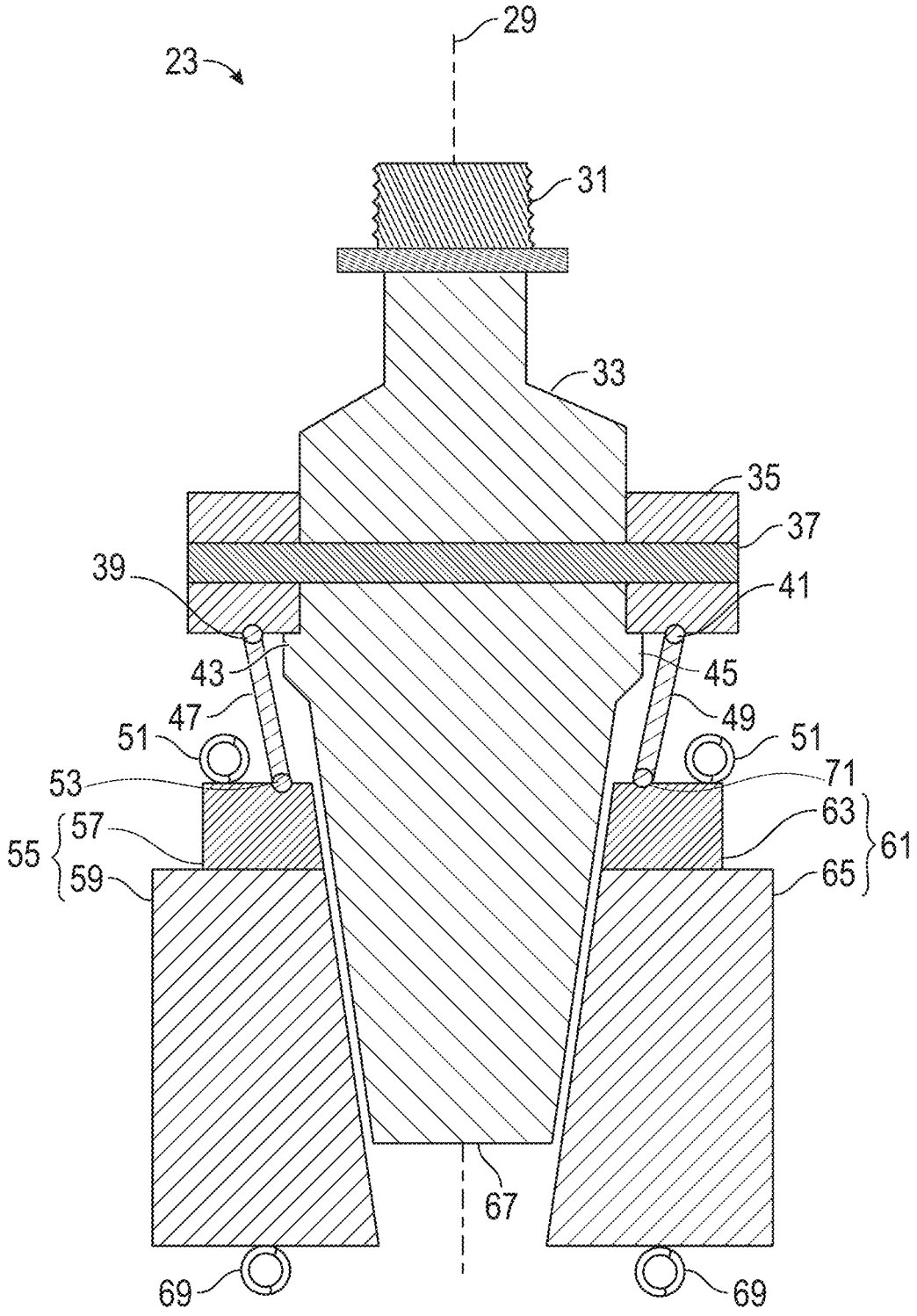
FIG. 2 depicts a tubing nipple impression device in accordance with one or more embodiments of the invention.

Turning to FIG. 2, FIG. 2 depicts a section view of a tubing nipple impression device 23 in accordance with one or more embodiments of the invention. The tubing nipple impression device 23 is formed of a plurality of components that serve to collectively actuate a first impression arm 55 and a second impression arm 61 in a lateral, or radial, direction. Structurally, the tubing nipple impression device 23 is primarily formed of a driver body 33, a stopping disk 35, and the first impression arm 55 and the second impression arm 61. The driver body 33 and the stopping disk 35 may be formed, for example, of metals such as steel, iron, aluminum, an alloy, a combination thereof, or derivatives thereof, for example, or any other material suitable for downhole operations known to a person of ordinary skill in the art.

The driver body 33 serves to actuate the first impression arm 55 and the second impression arm 61 of the tubing nipple impression device 23. Specifically, the driver body 33 extends along a vertical axis 29 of the wellbore 13, and includes a fishing neck 31, a first driver arm 43, a second driver arm 45, and a nose portion 67. The fishing neck 31 is a threaded connector that allows the driver body 33 to be fixed to a fishing tool (not shown) of a slickline 19. The first driver arm 43 and the second driver arm 45 are angled protrusions that extend in a radial (or lateral) direction from the driver body 33, and the nose portion 67 is a sloped surface that abuts against the first impression arm 55 and the second impression arm 61 to enlarge a radial distance therebetween as the driver body 33 is actuated. During operation, and as discussed below, the nose portion 67 is actuated in a downwards direction, and the abutment of the nose portion 67 to the first impression arm 55 and the second impression arm 61 causes the first impression arm 55 and the second impression arm 61 to expand in the wellbore 13 to contact the tubing nipple 27.

The first impression arm 55 and the second impression arm 61 are each formed with a head portion and a lead body that are rigidly fixed to each other. Specifically, the first impression arm 55 includes a first head portion 57 and a first lead body 59, while the second impression arm 61 includes a second head portion 63 and a second lead body 65. The first head portion 57 and the second head portion 63 are formed of a rigid metal, such as steel or iron, for example, while the first impression arm 55 and the second impression arm 61 are formed of a malleable metal such as lead or tin, for example.

The first head portion 57 is fixed to the first lead body 59 and the second head portion 63 is fixed to the second lead body 65, respectively, with a welding or brazing procedure, or using a mechanical fastener such as a bolt or screw, for example. This allows the first head portion 57 and the second head portion 63 to be actuated by the nose portion 67 of the driver body 33, while the first lead body 59 and the second lead body 65 are actuated by the first head portion 57 and the second head portion 63, respectively. That is, the driver body 33 abuts against the first head portion 57 and the second head portion 63 to actuate the first impression arm 55 and the second impression arm 61, such that the first lead body 59 and the second lead body 65 do not need to be in contact with the driver body 33 to actuate. By actuating the first lead body 59 and the second lead body 65 with the first head portion 57 and the second head portion 63 rather than the driver body 33 itself, the first lead body 59 and the second lead body 65 retain their shape until they abut against the tubing nipple 27. In this way, the first lead body 59 and the second lead body 65 remain undeformed from the motion of the driver body 33 while being actuated by the first head portion 57 and the second head portion 63.

Figure 3:
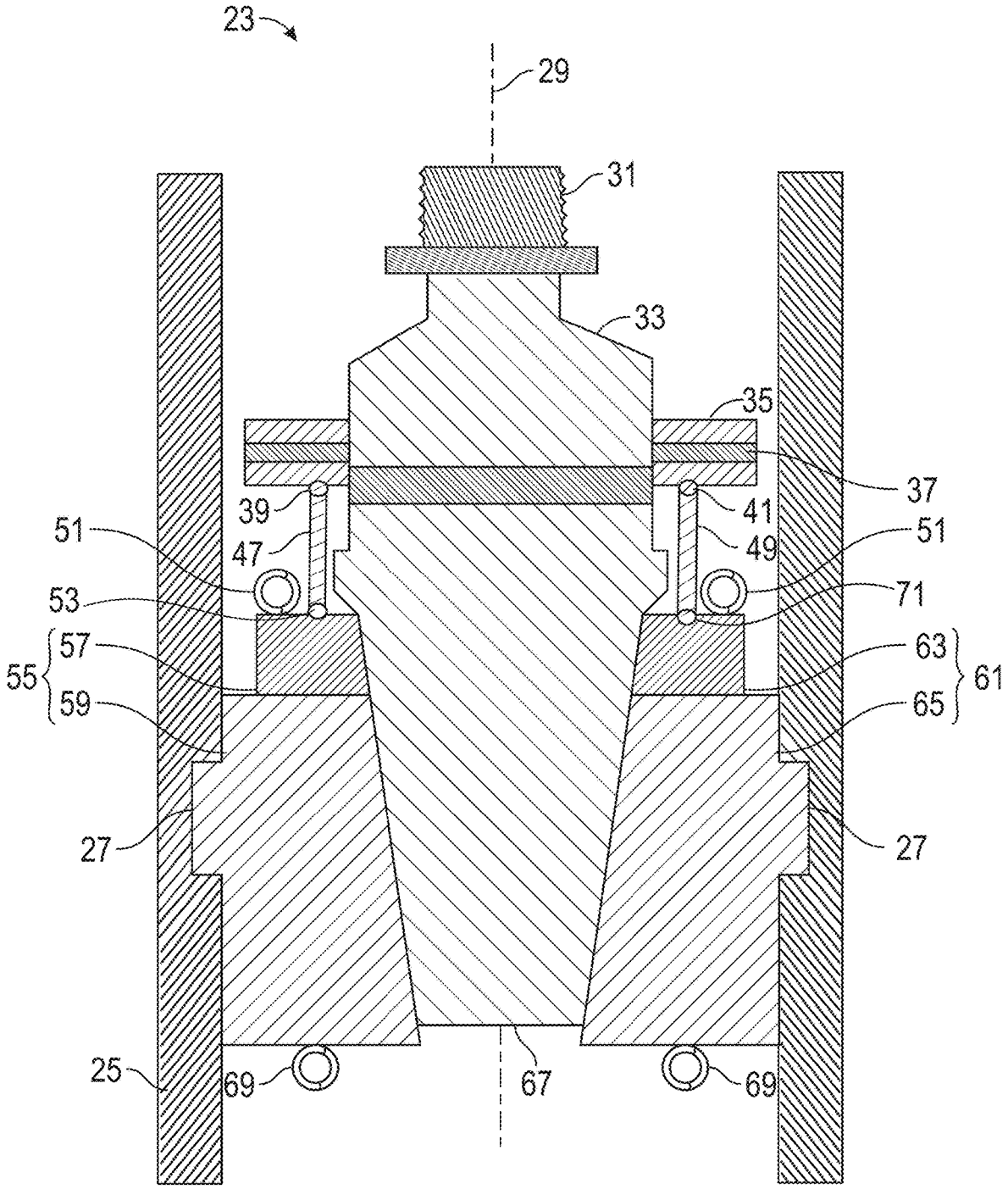
FIG. 3 depicts a tubing nipple impression device in accordance with one or more embodiments of the invention.

To further aid in forming an impression of the tubing nipple 27, the first lead body 59 and the second lead body 65 extend radially beyond the first head portion 57 and the second head portion 63, respectively. This ensures that the first lead body 59 and the second lead body 65 contact the tubing nipple 27 without interference from the first head portion 57 or the second head portion 63. Similarly, the first head portion 57 and the second head portion 63 are fixed to the first lead body 59 and the second lead body 65 such that an air gap is present between the lead bodies and the driver body 33 while the driver body 33 abuts against the first head portion 57 and the second head portion 63. This ensures that the driver body 33 is unable to deform the first lead body 59 or second lead body 65 during its actuation, as the driver body 33 is in contact with the first head portion 57 and the second head portion 63 instead. In addition, the second head portion 63 and the second lead body 65 are formed with a sloped internal profile that matches the profile of the first head portion 57 and the first lead body 59 to guide the motion of the driver body 33. Such is depicted in FIGS. 2 and 3 by the sloped nature of the first lead body 59 to match the profile of the driver body 33, and the sloped nature may also be applied to the second impression arm 61 as well. Alternatively, an internal profile of the first impression arm 55 and the second impression arm 61 may be sloped to match the driver body 33, while an external profile of the first impression arm 55 and the second impression arm 61 is curved to match the stopping disk 35 and/or the completion tubing 25.

To maintain the abutment of the first head portion 57 and the second head portion 63 to the nose portion 67 of the driver body 33, the tubing nipple impression device 23 further includes a plurality of radial springs that interconnect the first impression arm 55 to the second impression arm 61. Specifically, an upper radial spring 51 connects the first head portion 57 to the second head portion 63, while a lower radial spring 69 interconnects the first lead body 59 to the second lead body 65. The upper radial spring 51 and the lower radial spring 69 deliver a compressive force to the first impression arm 55 and the second impression arm 61 that retains the arms to the driver body 33 while the driver body 33 is actuated downwards. In addition, the upper radial spring 51 and the lower radial spring 69 may surround the entirety of the tubing nipple impression device 23 such that the driver body 33 extends through the upper radial spring 51 and the lower radial spring 69. Alternatively, the upper radial spring 51 and lower radial spring 69 may only extend partially around the circumference of the tubing nipple impression device 23, or may be formed of multiple pieces to ease the assembly process of the tubing nipple impression device 23.

The first impression arm 55 and the second impression arm 61 are also indirectly connected to the driver body 33 prior to actuation. In particular, and as shown in FIG. 2, the first head portion 57 is connected to a first pivot arm 47 with a first pivot pin 53, and the second head portion 63 is connected to a second pivot arm 49 with a second pivot pin 71. The first pivot pin 53 and the second pivot pin 71 may be embodied, for example, as a rod (or "pin") that rotates within a hole or orifice of the first head portion 57 and the second head portion 63, respectively. The first pivot arm 47 and the second pivot arm 49 are formed of steel or an equivalent metal as described herein. At their other end, the first pivot arm 47 and the second pivot arm 49 are connected, with a third pivot pin 39 and a fourth pivot pin 41, respectively, to a stopping disk 35 that is connected to the driver body 33 by way of a shear pin 37. Thus, the first impression arm 55 and the second impression arm 61 are hinged to the stopping disk 35, and can rotate away from the stopping disk 35 and the driver body 33 to abut against the completion tubing 25 and tubing nipple 27 depicted in FIG. 1.

Keeping with FIG. 2, the stopping disk 35 is an annular block of metal that surrounds the upper portion of the driver body 33, and serves to prevent the driver body 33 from actuating excessively vertically upwards during the process of creating an impression of the tubing nipple 27. To this end, the driver body 33 includes a first driver arm 43 and a second driver arm 45 that extend radially therefrom, and the stopping disk 35 rests upon the first driver arm 43 and the second driver arm 45. The stopping disk 35 is further connected to the driver body 33 by way of a shear pin 37 as noted above, which extends radially through the stopping disk 35 and the driver body 33.

To actuate the driver body 33, the driver body 33 includes a fishing neck 31 formed as a threaded connection as described above. The fishing neck 31 is connected to a fishing tool (not shown) of a slickline 19 as depicted in FIG. 1. During a downhole operation, the driver body 33 is actuated with a jarring motion of the slickline 19, which shears the shear pin 37 and forces the driver body 33 away from the stopping disk 35. The downward actuation of the driver body 33 causes the sloped nose portion 67 to abut against the first impression arm 55 and the second impression arm 61, which causes the first impression arm 55 and the second impression arm 61 to radially actuate.

Turning to FIG. 3, FIG. 3 depicts a section view of a tubing nipple impression device 23 in an actuated position according to one or more embodiments of the invention. As shown in FIG. 3, the driver body 33 of the tubing nipple impression device 23 has been forced downward, breaking the shear pin 37 that interconnects the stopping disk 35 and the driver body 33. As noted above, the downward force on the driver body 33 is created by a jarring or rapid movement by the slickline 19, which is attached to the tubing nipple impression device 23 by way of a fishing tool (not shown) that is fixed to the fishing neck 31 of the driver body 33. The downward force on the driver body 33 is transmitted through the sloped nose portion 67 to the first impression arm 55 and the second impression arm 61. This force, in turn, causes the first impression arm 55 and the second impression arm 61 to rotate about the stopping disk 35 via the first pivot arm 47 and the second pivot arm 49, respectively, until the first impression arm 55 and the second impression arm 61 contact the tubing nipple 27.

After the initial jarring force is applied to the driver body 33, a continued force is applied to the driver body 33 to maintain contact between the first lead body 59 and the tubing nipple 27 and the second lead body 65 and the tubing nipple 27. During this period of time, the first lead body 59 and the second lead body 65 form to the shape of a portion of the tubing nipple 27, thereby creating a partial profile of the tubing nipple 27. Because the tubing nipple 27 is a symmetrical and uniform cutout of the completion tubing 25, the partial profiles captured by the first lead body 59 and the second lead body 65 are sufficient to identify the geometry of the tubing nipple 27 as a whole. Once the first lead body 59 and the second lead body 65 have conformed to the shape of the tubing nipple 27, an upward force is applied to the driver body 33 via the slickline 19, which causes the first impression arm 55 and the second impression arm 61 to withdraw from the tubing nipple 27. That is, once the driver body 33 has an upward force applied thereto, the upper radial spring 51 and the lower radial spring 69 apply a compressive force to the first impression arm 55 and the second impression arm 61 causing their withdrawal from the tubing nipple 27. With the first lead body 59 and the second lead body 65 dislodged from the tubing nipple 27, the driver body 33 may be freely lifted through the completion tubing 25 to the surface, where the first lead body 59 and the second lead body 65 are analyzed to determine the profile of the tubing nipple 27.

Figure 4:
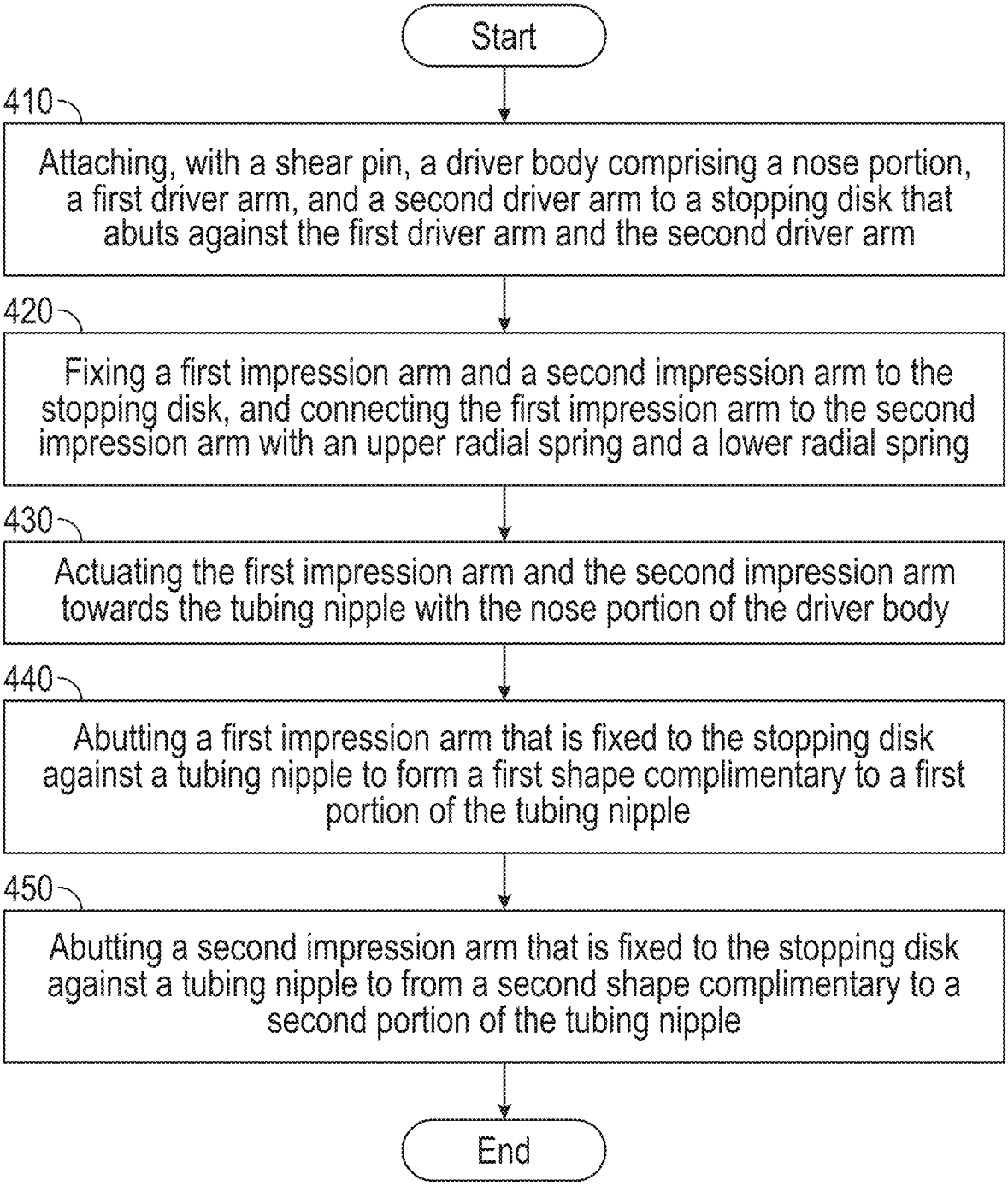
FIG. 4 depicts a flowchart of a method in accordance with one or more embodiments of the present disclosure.

FIG. 4 depicts a flowchart of a method for creating an impression of a tubing nipple consistent with one or more embodiments of the invention as described herein. The steps of FIG. 4 may be performed, for example, by the aforementioned tubing nipple impression device 23, but are not limited thereto. Additionally, the constituent steps of the method depicted in FIG. 4 may be performed in any logical order, and are not limited to the sequence presented. Finally, steps of FIG. 4 may be performed simultaneously or as part a single action, or a single step may be performed with multiple actions.

The method of FIG. 4 initiates with step 410, in which a driver body 33 is attached to a stopping disk 35 with a shear pin 37. The driver body 33 includes a nose portion 67 with an angled or otherwise sloped profile relative to a vertical axis 29. In addition, the driver body 33 includes an integrally formed first driver arm 43 and second driver arm 45 that laterally extend away from the driver body 33 towards the completion tubing 25. The first driver arm 43 and the second driver arm 45 provide a shelf for the stopping disk 35 to rest upon, which eases the stress placed on the shear pin 37 while the tubing nipple impression device 23 is lowered through the completion tubing 25. The shear pin 37 is attached to the driver body 33 and the stopping disk 35 by inserting the shear pin 37 into orifices that extend through the driver body 33 and the stopping disk 35. Specifically, each of the driver body 33 and the stopping disk 35 are formed with an orifice having the same diameter as the shear pin 37, and the orifices are aligned while the stopping disk 35 rests on the driver body 33 such that the shear pin 37 may be inserted therethrough. Once the shear pin 37 has been inserted through the driver body 33 and the stopping disk 35, the method proceeds to step 420.

In step 420, a first impression arm 55 and a second impression arm 61 are interconnected by an upper radial spring 51 and a lower radial spring 69, and are attached to the stopping disk 35. It is noted that step 410 and step 420 may be performed in any order, or as part of a single step, as steps 410 and 420 are directed towards the assembly of a tubing nipple impression device 23 overall. During step 420, the first impression arm 55 and the second impression arm 61 are connected by brazing or welding (or equivalent procedure) an upper radial spring 51 to a first head portion 57 and a second head portion 63 of the first impression arm 55 and the second impression arm 61, respectively. Similarly, a lower radial spring 69 is fixed to the lowermost portions of the first lead body 59 and the second lead body 65. The upper radial spring 51 and the lower radial spring 69 collectively serve to withdraw the first impression arm 55 and the second impression arm 61 from the tubing nipple 27 after an impression is formed with the first lead body 59 and the second lead body 65, as described above.

The first impression arm 55 and the second impression arm 61 are attached to the stopping disk 35 by way of a first pivot arm 47 and a second pivot arm 49. Specifically, the first pivot arm 47 is attached to the first impression arm 55 by way of a first pivot pin 53, and is further attached to the stopping disk 35 by way of a third pivot pin 39. Similarly, the second pivot arm 49 is connected to the second impression arm 61 by way of a second pivot pin 71, and is further connected to the stopping disk 35 by way of a fourth pivot pin 41. Each of the first pivot pin 53, the second pivot pin 71, the third pivot pin 39 and the fourth pivot pin 41 may be embodied as a pin and hole joint that allow the first impression arm 55 and the second impression arm 61 to be connected to the stopping disk 35 in a hinged fashion. In turn, this allows the first impression arm 55 and the second impression arm 61 to maintain a fixed distance from the stopping disk 35, and ensures that a uniform impression of the tubing nipple 27 is created. Once the first impression arm 55 and the second impression arm 61 are fixed to the stopping disk 35, the method proceeds to step 430.

In step 430, the first impression arm 55 and the second impression arm 61 are actuated towards the tubing nipple 27. In this step, the driver body 33 is forced downwards by a quick, jarring motion of the slickline 19. This causes the shear pin 37 to shear and release the driver body 33 from the stopping disk 35. The driver body 33 is wedged between the first impression arm 55 and the second impression arm 61, which causes the first impression arm 55 and the second impression arm 61 to actuate in a radial direction towards the completion tubing 25 and the tubing nipple 27. At this point, the method proceeds to step 440.

In step 440, the first impression arm 55 is abutted against the tubing nipple 27 to form the first lead body 59 into a first shape complimentary to a first portion of the tubing nipple 27. Specifically, during this step the driver body 33 continues to press on the first head portion 57 of the first impression arm 55, and the first lead body 59 that is fixed to the first head portion 57 is pressed into the tubing nipple 27 as a consequence. As noted above, the first lead body 59 is attached to the first head portion 57 with a brazing or welding process, or an adhering mechanism such as rivets, screws, or bolts. In addition, the first lead body 59 is positioned such that the first lead body 59 extends further towards the tubing nipple 27 than the first head portion 57 in an axial direction, which allows the first lead body 59 to abut against the tubing nipple 27 prior to the first head portion 57 abutting against the completion tubing 25. Due to the first lead body 59 being formed of a malleable material such as lead, tin, or silver, for example, the first lead body 59 molds to the shape of the tubing nipple 27 while abutted. This creates an impression of a portion of the tubing nipple 27, which is representative of the entirety of the tubing nipple 27 due to the symmetrical nature thereof.

In step 450, the second impression arm 61 is also abutted against the tubing nipple 27 to create a second shape complimentary to a second portion of the tubing nipple 27. It is noted that steps 440 and 450 may be performed by a single actuation of the driver body 33, and may occur simultaneously as a result. During step 450, and similar to step 440, the driver body 33 is actuated downwards and abuts against the second head portion 63 of the second impression arm 61, which causes the second impression arm 61 to move in a radial direction to abut the second lead body 65 against the tubing nipple 27. As the second lead body 65 is pressed into the tubing nipple 27, the second lead body 65 molds to the shape of the tubing nipple 27 to form a second impression complimentary to a second portion of the tubing nipple 27. The first impression and the second impression may be compared to determine if the tubing nipple 27 is damaged or uniform, and the redundancy of creating a second impression avoids the need for a second downhole trip if the first impression is not properly formed or becomes damaged. Once the first and the second impression have been created by the first lead body 59 and the second lead body 65, the driver body 33 is lifted by the slickline 19, which causes the first impression arm 55 and the second impression arm 61 to withdraw towards the vertical axis 29 by way of the upper radial spring 51 and the lower radial spring 69. The tubing nipple impression device 23 is then lifted to the surface of the Earth for further analysis of the first impression arm 55 and the second impression arm 61, which completes the tubing nipple 27 impression creation process.

Accordingly, the aforementioned embodiments of the invention as disclosed relate to devices and methods useful to create an impression of a tubing nipple of a wellbore. In addition, embodiments of the invention are capable of simultaneously creating multiple impressions of different portions of a tubing nipple, which allows the uniformity of the tubing nipple as a whole to be determined by comparing differences in the impressions. Furthermore, embodiments of the invention receive the benefits of a compact design, as the upper and lower radial springs ensure that the impression arms remain withdrawn while the tubing nipple impression device is raised and lowered within the wellbore.

Although only a few embodiments of the invention have been described in detail above, those skilled in the art will readily appreciate that many modifications are possible in the example embodiments without materially departing from this invention. For example, the first and the second impression arms may be operated with a motor rather than requiring the driver body to be actuated. In addition, the driver body may be formed with a curved or rounded nose portion to change the actuation path of the impression arms. Furthermore, the internal and external profile of the first impression arm and the second impression arm may vary as described herein, and the first impression arm may be symmetrical to the second impression arm or vary in design. Finally, the tubing nipple impression device may be lowered into the wellbore with a drill string rather than a slickline. Accordingly, all such modifications are intended to be included within the scope of this disclosure as defined in the following claims.

What is claimed is:

1. A tubing nipple impression device for use within downhole tubing, the device comprising:

a driver body that extends in an axial direction along a vertical axis of the downhole tubing, the driver body comprising a nose portion, a first driver arm, and a second driver arm;

a stopping disk that abuts against the first driver arm and the second driver arm of the driver body;

a shear pin that attaches the driver body to the stopping disk;

a first impression arm fixed to the stopping disk that is configured to form a first impression complimentary to a first portion of a tubing nipple when the first impression arm abuts against the tubing nipple;

a second impression arm fixed to the stopping disk that is configured to form a second impression complimentary to a second portion of the tubing nipple when the second impression arm abuts against the tubing nipple;

an upper radial spring that connects the first impression arm to the second impression arm; and a lower radial spring that connects the first impression arm to the second impression arm, wherein the nose portion of the driver body is configured to actuate the first impression arm and the second impression arm towards the tubing nipple to create an impression of the tubing nipple.

2. The tubing nipple impression device of claim 1, wherein the nose portion of the driver body has a sloped profile such that the nose portion is configured to enlarge a radial distance between the first impression arm and the second impression arm as the driver body is actuated.

3. The tubing nipple impression device of claim 1, wherein the upper radial spring and the lower radial spring are configured to actuate the first impression arm and the second impression arm after the impression is created to dislodge the first impression arm and the second impression arm from the tubing nipple.

4. The tubing nipple impression device of claim 1, wherein the first impression arm is fixed to the stopping disk with a first pivot arm and the second impression arm is fixed to the stopping disk with a second pivot arm.

5. The tubing nipple impression device of claim 4, wherein the first impression arm comprises a first head portion configured to be fixed to the first pivot arm, and a first lead body that is malleable to form the impression complimentary to the first portion of the tubing nipple when the first head portion abuts against the tubing nipple.

6. The tubing nipple impression device of claim 4, wherein the second impression arm comprises a second head portion configured to be fixed to the second pivot arm, and a second lead body that is malleable to form the impression complimentary to the second portion of the tubing nipple when the second head portion abuts against the tubing nipple.

7. The tubing nipple impression device of claim 1, further comprising: a threaded connector configured to connect the driver body to a slickline, the slickline being configured to actuate the driver body in the axial direction.

8. The tubing nipple impression device of claim 1, wherein the first driver arm and the second driver arm extend in a radial direction from the driver body.

9. The tubing nipple impression device of claim 1, wherein the upper radial spring is configured to be attached to a first head portion of the first impression arm and a second head portion of the second impression arm.

10. The tubing nipple impression device of claim 1, wherein the lower radial spring is configured to be attached to a first lead body of the first impression arm and a second lead body of the second impression arm.

11. A method for creating an impression of a tubing nipple, the method comprising:

attaching, with a shear pin, a driver body to a stopping disk, wherein the driver body extends in an axial direction along a vertical axis of downhole tubing and comprises a nose portion, a first driver arm, and a second driver arm, and wherein the stopping disk abuts against the first driver arm and the second driver arm;

fixing a first impression arm and a second impression arm to the stopping disk, and connecting the first impression arm to the second impression arm with an upper radial spring and a lower radial spring;

actuating the first impression arm and the second impression arm towards the tubing nipple with the nose portion of the driver body;

abutting the first impression arm against the tubing nipple to form a first impression complimentary to a first portion of the tubing nipple; and abutting the second impression arm against the tubing nipple to form a second impression complimentary to a second portion of the tubing nipple.

12. The method of claim 11, wherein actuating the first impression arm and the second impression arm to create the impression comprises: abutting a sloped profile of the nose portion against the first impression arm and the second impression arm and actuating the driver body, thereby enlarging a radial distance between the first impression arm and the second impression arm as the driver body is actuated.

13. The method of claim 11, further comprising: actuating the first impression arm and the second impression arm with the upper radial spring and the lower radial spring after the impression is created and dislodging the first impression arm and the second impression arm from the tubing nipple.

14. The method of claim 11, further comprising: fixing the first impression arm to the stopping disk with a first pivot arm and fixing the second impression arm to the stopping disk with a second pivot arm.

15. The method of claim 11, further comprising: forming the impression complimentary to the first portion of the tubing nipple by abutting a malleable first lead body of the first impression arm against the tubing nipple.

16. The method of claim 11, further comprising: forming the impression complimentary to the second portion of the tubing nipple by abutting a malleable second lead body of the second impression arm against the tubing nipple.

17. The method of claim 11, further comprising: connecting the driver body to a slickline with a threaded connector and actuating the driver body in the axial direction with the slickline.

18. The method of claim 11, wherein the first driver arm and the second driver arm extend in a radial direction from the driver body.

19. The method of claim 11, further comprising: attaching the upper radial spring to a first head portion of the first impression arm and a second head portion of the second impression arm.

20. The method of claim 11, further comprising: attaching the lower radial spring to a first lead body of the first impression arm and a second lead body of the second impression arm.

* * * * *